United States Patent [19]

Williamson

[11] Patent Number: 4,463,812

[45] Date of Patent: Aug. 7, 1984

[54] EARTH MOVING APPARATUS

[76] Inventor: Andrew O. Williamson, 416 7th Ave. South, Greybull, Wyo. 82426

[21] Appl. No.: 466,604

[22] Filed: Feb. 15, 1983

Related U.S. Application Data

[63] Continuation-in-part of Ser. No. 290,684, Aug. 6, 1981, abandoned.

[51] Int. Cl.[3] ..... E02F 3/76

[52] U.S. Cl. ..... 172/136; 172/777; 172/254

[58] Field of Search ..... 172/136, 254, 777, 197, 172/701.1, 701.2, 701.3; 37/2 R

[56] References Cited

U.S. PATENT DOCUMENTS

| | | | |
|---|---|---|---|
| 2,081,192 | 5/1937 | Allin | 172/777 |
| 2,304,282 | 8/1942 | Ross | 172/777 X |
| 2,446,074 | 7/1948 | Blackmore | 172/777 |
| 2,494,225 | 1/1950 | Blake | 172/777 X |
| 2,771,693 | 11/1956 | Busque | 172/777 X |

FOREIGN PATENT DOCUMENTS

| | | | |
|---|---|---|---|
| 508471 | 12/1954 | Canada | 172/136 |
| 140523 | 5/1953 | Sweden | 172/177 |

*Primary Examiner*—Richard J. Johnson
*Attorney, Agent, or Firm*—Arthur L. Urban

[57] ABSTRACT

Apparatus for mounting on earth moving machinery including a blade portion, a rake portion, a support portion and a mounting portion; the blade portion including a substantially straight elongated plate section and a curved section extending therefrom; the rake portion including a plurality of spaced tooth members associated with the blade portion, the tooth members being disposed generally transversely of the length of the blade portion, each of the tooth members including a shank section and a hook section, each of the shank sections being disposed between a pair of spaced cross members extending substantially perpendicular to the plate section, aligned openings through the pair of cross members and the shank section and a pin extending therethrough; the support portion including a bar member supporting the tooth members, a longitudinal section located adjacent to the bar member; the mounting portion including side connectors disposed adjacent the side edges of the bar member, arm members releasably engageable with the side connectors, the arm members extending from the connectors on one side of the apparatus being joined at the ends thereof remote from the blade portion, a pivotal central connector with an outwardly extending shaft disposed centrally between the side connectors both horizontally and vertically and at the pivotal balance point.

8 Claims, 3 Drawing Figures

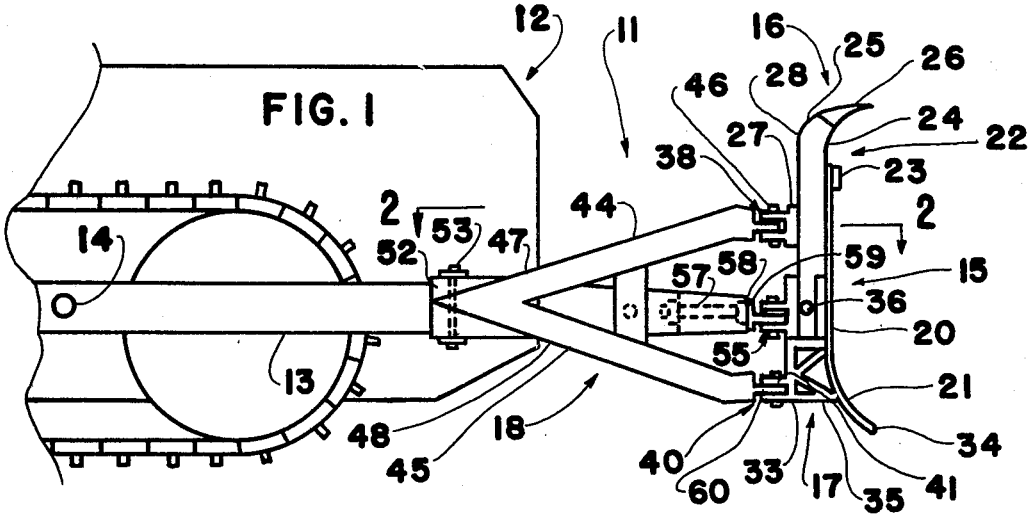
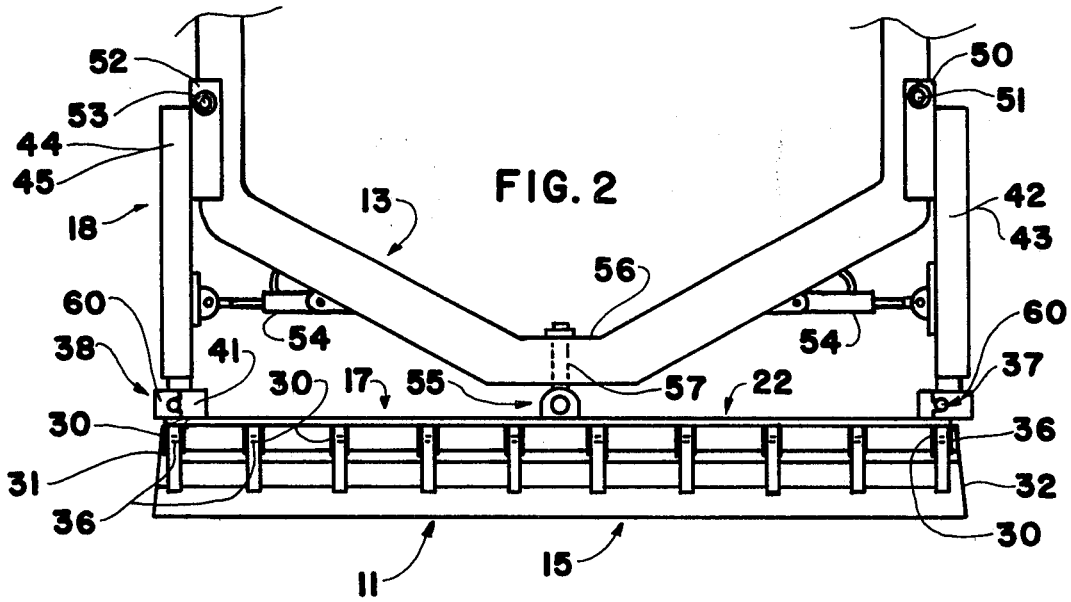
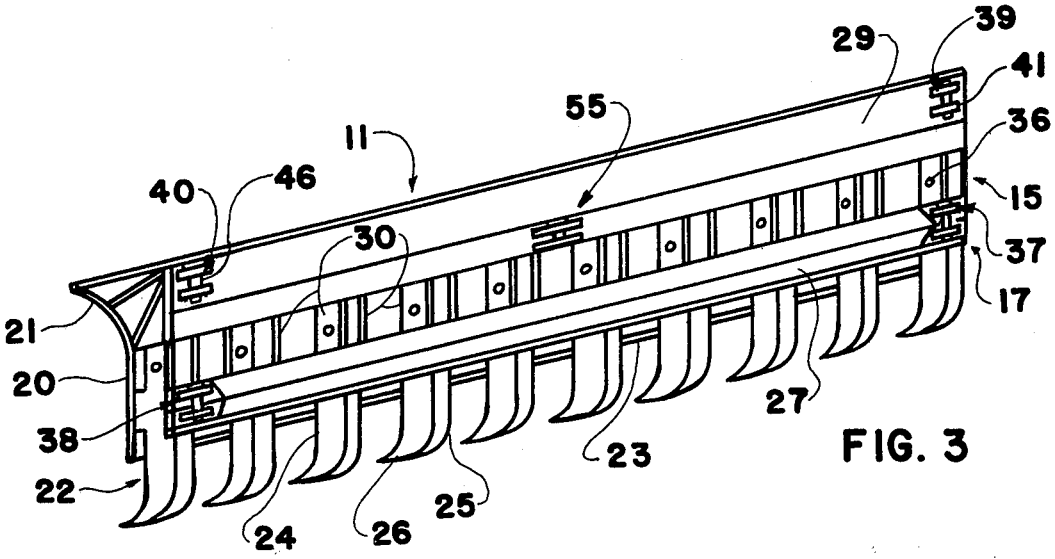
FIG. 3

EARTH MOVING APPARATUS

This application is a continuation-in-part of pending application Ser. No. 290,684, filed Aug. 6, 1981 now abandoned.

This invention relates to a novel apparatus for moving earth and more particularly relates to a new apparatus for moving soil, rocks and the like.

Throughout history, man has worked on the soil. Some of the work was simply the activities associated with the tilling and the cultivating of the soil in connection with the growing of crops. Another area in which earth working is of major importance is in the construction of buildings and roads. In the latter situations, it is customary to move soil from one location to another, either temporarily or permanently.

In the construction of buildings, holes, trenches, etc. are dug for foundations, basements and the like. Road construction generally requires that large amounts of soil, rock and the like must be moved from one area to another to provide the desired grade for the roadway.

Many years ago, this earth moving was accomplished with simple equipment. For a long period, earth was moved with scoops or buckets drawn by horses or other animals. Later, with the development of engines, earth was moved with tractors that had accessories such as blades, drags, etc. This machinery did increase the amount of soil that could be moved in a given period of time. However, since the equipment was not specifically designed for the job it was doing, there was considerable inefficiency in its operation.

The necessity for moving greater amounts of earth in a given period of time resulted in the development of special machinery designed specifically for earth moving. One piece of equipment that has gained wide acceptance is the so-called bulldozer. The bulldozer usually employs an engine mounted on endless tracks. Movable arms extend from the front of the vehicle with a blade being mounted on the ends of the arms. The blade may be raised or lowered as well as the angle of the blade changed from the operator's station.

A bulldozer may be used for a variety of different tasks. The bulldozer ordinarily is used to move soil and level it. It can push soil in front of the machine with the blade. For leveling, the blade can be raised slightly so that it leaves a portion of the soil behind as the bulldozer moves forward. Also, the blade can utilize a scoop to carry soil from one location to another.

One of the difficulties encountered with the use of a bulldozer is leveling soil containing a substantial number of rocks or boulders. While it is possible to move rocky soil with the blade, it is difficult to level the soil with any degree of uniformity since the rocks tend to create irregularities in the smoothness of the surface.

To properly level the soil, it is necessary to remove the rocks and boulders prior to leveling. This can be accomplished with a bulldozer through the use of a rake. Rakes that can be used on the front of a bulldozer have been available for many years. These accessories either replace the blade or are mounted over the blade.

While commercially available rakes do a satisfactory job of removing rocks and boulders from soil, there are certain problems in their use. From the viewpoint of the equipment owner and the operator, one of the main problems with commercially available rakes is the amount of time required to convert the bulldozer from earth moving to raking. Replacing the blade with the rake takes considerable time and effort. Also, adding the rake assembly to the blade takes a similar amount of time.

A further difficulty with blade replacement is that when doing roadbed grading, the bulldozer ordinarily moves along the roadway as the roadway is being prepared. With such a situation, it is necessary to arrange for the transfer of the rake along the roadway from one location to another between uses. This may necessitate the deployment of a special truck and driver to move the rake together with a crane or other equipment to lift the rake onto the bed of the truck. All of this can be time consuming and expensive.

The present invention provides a novel apparatus for working soil. The apparatus of the present invention provides a simple and convenient means for alternatively performing raking or blading operations with a bulldozer. The apparatus enables a bulldozer operator to switch from blading to raking and back again easily and quickly by himself. The apparatus does not require the removal of the blade from the bulldozer when raking. The implement, that is, the blade or rake, which is not being used is self-storing on the bulldozer so it does not have to be hauled separately. The apparatus of the invention allows an operator to make the conversion from his operating station.

The apparatus of the present invention is simple in design and can be manufactured relatively inexpensively. The apparatus is substantially less costly than the combination of conventional blades and rakes. The apparatus can be fabricated from commercially available components and materials using conventional earth moving equipment manufacturing techniques and procedures.

The apparatus is durable in construction and has a long useful life with a minimum of maintenance. The apparatus is adaptable both to new bulldozers and those presently in use. Installation of the apparatus of the invention on a bulldozer can be accomplished with minimum expense and labor.

Other benefits and advantages of the novel earth moving apparaus of the present invention will be apparent from the following description and accompanying drawings in which:

FIG. 1 is a side elevation of one form of the earth moving apparatus of the invention mounted on the front of a bulldozer;

FIG. 2 is a top view of the earth moving apparatus shown in FIG. 1 in section taken along line 2—2 thereof; and FIG. 3 is a view in perspective from the rear of the earth moving apparatus shown in FIGS. 1 and 2.

As shown in the drawings, one form of the novel earth-moving apparatus 11 of the present invention is mounted on the front of a bulldozer 12. The apparatus 11 is attached to a framework 13 extending around the front of the bulldozer. The framework 13 is pivotally connected at its ends 14 to the bulldozer 12. This pivotal connection enables the framework 13 and the apparatus 11 mounted thereon to be raised or lowered by suitable actuators such as hydraulic cylinders (not shown).

The earth moving apparatus 11 of the present invention as shown includes a blade portion 15, a rake portion 16, a support portion 17 and a mounting portion 18. Blade portion 15 includes a substantially straight, elongated plate section 20. The plate section 20 has a length substantially greater than its height. The plate section is disposed in a generally vertical position.

The blade portion 15 also includes a curved section 21 extending from one longitudinal edge of the plate section 20 along substantially the entire length of the plate section. Advantageously, the plate section 20 and the curved section 21 are formed as a unitary structure.

The rake portion 16 includes a plurality of tooth members 22 associated with the blade portion 15. The tooth members 22 are disposed generally transversely of the length or longitudinal edge 23 of the blade portion 15. Each of tooth members 22 includes a shank section 24 and a hook section 25 extending from one end of the shank section.

The shank section 24 of each tooth member 22 overlaps and is in contact with plate section 20 of the blade portion 15. Each shank section 24 is disposed between a pair of spaced cross members 30. The cross members 30, together with plate section 20 and a bar member 27 of support portion 17 form a series of sockets into which the shank sections 24 of the teeth are inserted. Also, a pin 36 extends through openings in the pairs of cross members 30 and in each shank section 24 to retain the tooth members 22 in place.

Hook section 25 including a curved end 26 extends a substantial distance beyond the longitudinal edge 23 of the plate section 20. The curved end 26 of the hook section 25 projects from the hook section 25 in the same direction as the curved section 21 of the blade portion 15.

The support portion 17 includes a bar or strip member 27 that supports the tooth members 22. The bar member 27 is disposed on the opposite side 28 of the tooth members 22 from that adjacent to the blade portion 15. The bar member 27 is disposed adjacent and substantially parallel to the longitudinal edge 23 of the plate section 20.

The support portion 17 further includes a longitudinal section 29 located adjacent and substantially parallel to the bar member 27. The longitudinal section 29 extends from one side 31 of the blade portion 15 to the other side 32. The longitudinal section 29 is disposed with one edge 33 thereof adjacent to the free edge 34 of the curved section 21 of the blade portion 15. The longitudinal section 29 extends from the edge 33 toward the bar member 27.

Advantageously, the longitudinal section 29 is secured to the blade portion 15 but is spaced therefrom such as with spacers 35. Preferably, the longitudinal section 29 extends from the sides 28 of the tooth members 22 remote from the blade portion 15.

The mounting portion 18 of the earth moving apparatus 11 includes side connecting means 37, 38, 39 and 40 disposed on the back of the blade portion 15. The side connecting means 37 and 38 are disposed adjacent the side edges of the bar member 27. The connecting means 39 and 40 are disposed adjacent the side edges of the longitudinal section 29. As shown, the connecting means 37–40 each include a pair of spaced bracket plates 41 with a pin 46 extending therebetween.

Arm members 42, 43, 44 and 45 are releasably engageable with the respective side connecting means 37, 39, 38 and 40. The arm members 42 and 43 extending from connecting means 37 and 39 on one side of the apparatus 11 converge toward each other and are joined at the ends 47 and 48 thereof that are remote from the blade portion 15. The joined arm members 42 and 43 are disposed in a generally vertical plane. The joined arm members 42 and 43 include connecting means such as bracket 50 and pin 51 to secure the arm members to framework 13. In the same way, arm members 44 and 45 extending from connecting means 38 and 40 are joined at bracket 52 which is connected to framework 13 through pin 53.

Advantageously, the arm member assemblies 42/43 and 44/45 are pivotable with respect to the framework 13. The pivotal connection of the arm member assemblies may be achieved through pins 51 and 53, respectively. To facilitate movement of the arm member assemblies, pistons 54 extend between the angled sections of the framework 13 and the arm assemblies.

Connection of the free ends of the arm member assemblies 42/43 and 44/45 is accomplished through U-shaped links 60 extending from the arm assemblies. The open sides of the U-shaped links 60 face toward one another for engagement with pins 46 extending between the bracket plates 41 of connecting means 37–40.

The mounting portion 18 also includes central connecting means 55. The central connecting means 55 provides a pivotal connection with the front center 56 of the framework 13. The connecting means 55 is disposed centrally between the side connecting means 37–40. The central connecting means 55 is disposed halfway between the side connecting means both horizontally and vertically.

The central connecting means 55 includes a pivot with an outwardly extending shaft 57 that extends through an opening 58 in framework 13 including bearings 59. The central connecting means 55 is located at the pivotal balance point of the apparatus 11 to facilitate rotation thereof.

In the use of the earth moving apparatus of the invention as shown in the drawings, the apparatus 11 first is mounted on a bulldozer 12. This is accomplished by attaching bracket 50 joining arm members 42 and 43 to one side of framework 13 with pin 51. Similarly, bracket 52 joining arm members 44 and 45 is attached to the other side of framework 13 with pin 53. Then, the side connecting means 37–40 are connected to the end links 60 of the arm members 42–45 and the central connecting means 55 is engaged with the front center 56 of the framework. The apparatus 11 is now ready for use.

The bulldozer is used normally with the blade portion 15 pushing the soil in front of the dozer. If it is desired to separate rocks, boulders or other large material from the soil, the apparatus 11 is converted into a rake. This may be accomplished by driving the bulldozer onto a raised area so the apparatus can be suspended above the ground. This provides clearance for effecting the conversion.

The apparatus 11 is converted from a blade to a rake simply by disconnecting the end links 60 of the arm member assemblies 42/43 and 44/45 from the side connecting means 37–40. This can be accomplished by actuating pistons 54 to swing the arm assemblies away from the blade portion 15. The apparatus 11 then is rotated 180° about shaft 57 as a pivot.

When the apparatus 11 reaches a position with the tooth members 22 at the bottom, the respective side connecting means 37–40 are reconnected to the adjacent arm member assemblies by actuating pistons 54 again to draw the end links 60 between the respective bracket plates 41 and into engagement with pins 46. To facilitate engagement, the respective pairs of bracket plates may be bent to provide an enlarged guide area for entry of the links 60. The apparatus 11 now is ready for use as a rake.

The bulldozer may be maneuvered in the same way as with a conventinal rake until the raking operation is completed. At that time, the bulldozer is driven onto high ground and the disconnecting and rotating operations apparatus of the invention provides a simple and convenient means for alternately performing blading and/or raking operations with a bulldozer. The operator of a bulldozer can switch from blading to raking and back again easily and quickly. This change may be performed by the operator without assistance from his operating station if desired.

The use of the apparatus of the invention eliminates the need for two separate implements, that is, a blade and a rake. Since the apparatus of the invention can be employed for both operations, it is not necessary to haul the implement not being used in a separate vehicle as the bulldozer advances along a roadway job.

The apparatus of the present invention is simple in design and substantially lower in cost than the combination of separate blades and rakes. The apparatus can be fabricated from commercially available components and materials employing conventional earth moving equipment manufacturing techniques.

The apparatus of the invention is durable in construction and has a long useful life with little maintenance. The apparatus is suitable both for new bulldozers and those currently in use. Installation of the apparatus on a bulldozer can be accomplished with a minimum of expense and labor.

It will be apparent that various modifications can be made in the particular apparatus described in detail above and shown in the drawings within the scope of the invention. The size, configuration and arrangement of components can be changed to meet specific requirements. Also, the supporting and mounting means can be different.

These and other changes can be made in the apparatus provided the functioning and operation of the apparatus are not deleteriously affected. Therefore, the scope of the invention is to be limited only by the following claims.

What is claimed is:

1. Apparatus for mounting on earth moving machinery including a blade portion, a rake portion, a support portion and a mounting portion; said blade portion including a substantially straight elongated plate section, said plate section having a length substantially greater than its height and being disposed in a generally vertical position, a curved section extending from one longitudinal edge of said plate section along substantially the entire length thereof; said rake portion including a plurality of spaced tooth members associated with said blade portion, said tooth members being disposed generally transversely of the length of said blade portion, each of said tooth members including a shank section overlapping and in contact with said plate section of said blade portion, each of said shank sections being disposed between a pair of spaced cross members extending substantially perpendicular to said plate section, said cross members and said plate section forming a socket into which said shank section is removably disposed, aligned openings through said pair of cross members and said shank section, a pin extending through said openings in said cross members and said shank section, a hook section with a curved end extending from an end of said shank section, said hook section extending a substantial distance beyond the longitudinal edge of said plate section remote from said curved section, the curved end of each hook section projecting in the same direction as said curved section of said blade portion; said support portion including a bar member supporting said tooth members, said bar member being disposed on the opposite side of said shank portion of said tooth members from that of said blade portion, said bar member being disposed adjacent to and substantially parallel to the longitudinal edge of said plate section remote from said curved section, a longitudinal section located adjacent to and substantially parallel to said bar member and extending from one side of said blade portion to the other, said longitudinal section being disposed with one edge thereof adjacent to the free edge of said curved section of said blade portion and extending toward said bar member; said mounting portion including side connecting means disposed adjacent the side edges of said bar member and said longitudinal section, arm members releasably engageable with said side connecting means, said arm members extending from said connecting means on one side of said apparatus converging toward each other and being joined at the ends thereof remote from said blade portion, said joined arm members being disposed in a generally vertical plane, said joined arm members including connecting means adjacent the ends thereof remote from said blade portion, pivotal central connecting means disposed centrally between said side connecting means both horizontally and vertically, said central connecting means including pivot means with outwardly extending shaft means, said central connecting means being disposed at the pivotal balance point of said apparatus; whereby said apparatus can be converted from a blading operation to a raking operation by disconnecting said side connecting means from said arm members, rotating said apparatus 180° about said pivotal central connecting means, and reconnecting said side connecting means with said arm members.

2. Apparatus for mounting on earth moving machinery according to claim 1 wherein said plate section and said curved section of said blade portion from a unitary structure.

3. Apparatus for mounting on earth moving machinery according to claim 1 wherein said longitudinal section extends from the sides of said tooth members remote from said blade portion.

4. Apparatus for mounting on earth moving machinery according to claim 1 wherein said longitudinal section is secured to said blade portion but spaced therefrom.

5. Apparatus for mounting on earth moving machinery according to claim 1 wherein said connecting means includes a plurality of spaced brackets.

6. Apparatus for mounting on earth moving machinery according to claim 1 wherein said joined arm member connecting means includes pivotal connecting means.

7. Apparatus for mounting on earth moving machinery according to claim 1 including piston means mounted on said joined arm members.

8. Apparatus for mounting on earth moving machinery according to claim 1 including U-shaped link means disposed on the ends of said arm members adjacent to said side connecting means.

* * * * *